United States Patent [19]

van Nederveen

[11] Patent Number: 4,520,882

[45] Date of Patent: Jun. 4, 1985

[54] DRILL HEAD

[75] Inventor: Hans B. van Nederveen, Zeist, Netherlands

[73] Assignee: SKF Industrial Trading and Development Co., B.V., Nieuwegein, Netherlands

[21] Appl. No.: 208,533

[22] Filed: Nov. 20, 1980

Related U.S. Application Data

[62] Division of Ser. No. 887,931, Mar. 17, 1978, Pat. No. 4,276,788.

[30] Foreign Application Priority Data

Mar. 25, 1977 [NL] Netherlands ..... 7703234

[51] Int. Cl.[3] ..... E21B 10/36

[52] U.S. Cl. ..... 175/410

[58] Field of Search ..... 175/329, 330, 410, 409, 175/411, 374, 375; 51/307, 309

[56] References Cited

U.S. PATENT DOCUMENTS

| | | | |
|---|---|---|---|
| T970,002 | 5/1978 | Kidder | 175/410 |
| 3,605,923 | 9/1971 | Feenstra | 175/329 |
| 3,852,874 | 12/1974 | Pearson | 175/410 |
| 3,997,011 | 12/1976 | Staroba | 175/410 |
| 4,054,449 | 10/1977 | Dunn | 75/208 R |
| 4,098,362 | 7/1978 | Bonnice | 175/329 |

*Primary Examiner*—William F. Pate, III

*Attorney, Agent, or Firm*—Daniel M. Rosen

[57] ABSTRACT

A drill head having isostatically bonded therein the shank portions of hard, wear-resistant cutting elements. The drill head can include cutting elements of various shapes and contours. The varied shaped cutting elements result in additional resistance to forces encountered under operational conditions.

2 Claims, 5 Drawing Figures

DRILL HEAD

This is a division of application Ser. No. 887,931, filed Mar. 17, 1978, now U.S. Pat. No. 4,276,788.

BACKGROUND OF THE INVENTION

The invention relates to a process for the manufacture of a drill head comprising a core body with hard, wear-resistant cutting elements or cutters fitted therein and projecting from the surface and consisting in sequence of a (cutting) tip and a shank or shaft.

Such drill heads are known in the prior art, for example, U.S. Pat. No. 2,687,875 and from practical use. Fastened to drilling tools such drill heads are suitable for forming apertures in hard materials or holes and cavities in the earth. For this purpose a drill head is manufactured from a hard steel body in which very precise apertures must be machined; into such an aperture the shank or shaft portion of a cutting element may be inserted with a press fit. This known process of manufacture has hitherto had a restrictive effect on the shape of the shank portion of the cutting element, which has had a cylindrical or similar form. Apart from the expensive machining of the hard core body which is necessary, there is also a practical disadvantage; because of the relatively large external forces acting on these wear-resistant elements, they are prematurely loosened from their cylindrical or tubular mountings so that drilling is impeded or even becomes impossible.

SUMMARY OF THE INVENTION

The invention introduces a process whereby it is now possible to produce a drill head with the elimination of the above-mentioned restrictions in the shape of the shank or shaft and the associated disadvantage of premature loosening of the cutting elements from the core body. To this end, according to the invention, a compressible mold or template, for example a rubber casting mold, is filled with metal powder, at least the shank or shaft portion of the wear-resistant elements or cutters being embedded in the metal powder, the cutting tips of the cutters are exposed, and the whole combination is then isostatically compacted.

By means of this process hard, wear-resistant elements or cutters may be used in which the shank or shaft is fixed in the core body, that is, the mounting for such elements may now be given any desired shape, and may, for example, be divergent or tapering, and may be provided with grooves or projections consequently a nonseparable bond between the elements or cutters and the isostatically compacted core body is obtained. The invention moreover provides a drill head which is relatively simple to produce and thus less expensive, and which has a shape and properties that may be precisely determined.

The invention will now be more particularly described with reference to some exemplary embodiments, with emphasis on the advantages and other features of the invention.

DETAILED DESCRIPTION OF THE PREFERRED EMBODIMENTS

Figure 1:
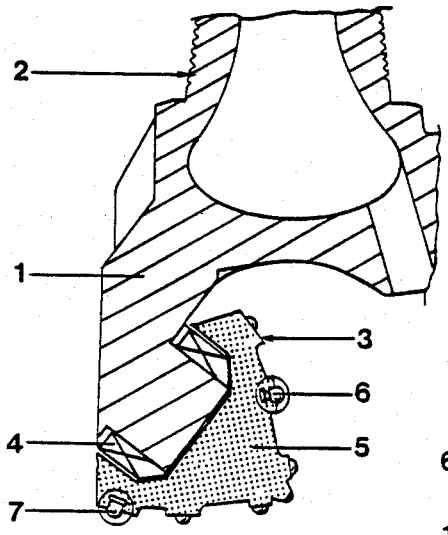
FIG. 1 shows partly in section a portion of a rotatable drill head according to the invention, suitable for drilling the earth's crust.

In the sectional view of FIG. 1 a conical drill element 3 is located on support 1 of a rotatable drill head 2 via bearing 4. The drill element 3 is made from metal powder 5 in accordance with the invention, the hard, wear-resistant elements 6, 7 (FIG. 1) or 8 (FIG. 4) which project from the surface being fastened in at the same time as it is produced.

Figure 2:
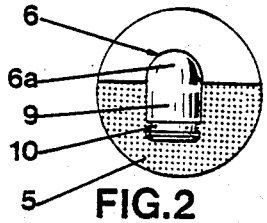
FIGS. 2 and 3 show side elevations, in enlarged scale, of embodiments of the hard, wear-resistant elements each with a rounded drill tip such as may be used in a drill head of the invention.
Figure 3:
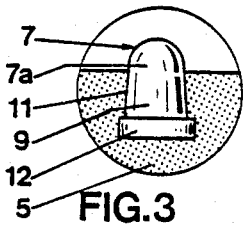

Manufacture is preferably effected by setting the tips 6*a* or 7*a* (see FIGS. 2 and 3) in part of a rubber mold (not shown) and then filling the whole mold with metal powder 5 before the combination consisting of the rubber mold or template containing the metal powder 5 and the elements 6 or 7 is compacted; accordingly one can effect the exact positioning of the hard, wear-resistant elements in the drill element or core body 3 which is to be provided before and during isostatic compacting. After compacting (in the first instance cold compacting) the rubber mold is removed, and in selected cases the "solid" conical drill element 3 is provided with the wear-resistant elements as seen in the embodiments of FIG. 2 and 3.

By means of the special design of the shank portion of the wear-resistant elements 6, 7 or 8 (see FIGS. 2, 3 and 4) in which, according to the invention, resistance-increasing means such as grooves 10 extending transversely of the longitudinal central axis or divergent shapes of stem 11 or projections 12 are used, an insoluble or nonseparable bond between these elements 6, 7 or 8 and the compacted drill element or core body 3 is now achieved. To obtain complete densification of drill element 3 hot isostatic compacting is often necessary so that mechanical properties equal to those of steel are achieved, with, however, the following important differences: (a) a better bond is obtained, that is, an insoluble or nonseparable bond, between the hard, wear-resistant elements 6, 7 or 8 and the core body 3; (b) also the prior disadvantage is eliminated, that is, the prior necessity of the accurate machining of the fixing apertures for the shank or shaft 9 of the wear-resistant elements in the core body. It should be noted that according to FIG. 3 the element 7 at the base of the tapered shank or shaft has a foot 12 partly projecting from it which makes the nonseparable bond between element 7 and core body 3 still more complete.

Figure 4:
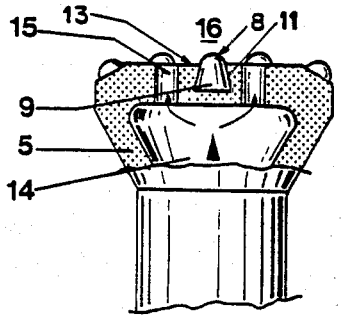
FIG. 4 shows a side elevation of a portion of another embodiment of a rotatable drill head for rock-drilling which is air-driven.

FIG. 4 shows a cross-section of a drill head 13 which is driven by compressed air, see arrow 14, the air being able to escape via eccentrically located apertures 15 in the face 16 of the drill. The hard wear-resistant elements 8, the shank or shaft 9 of which is divergent or tapering, are located on this face 16 of drill head 13.

Figure 5:
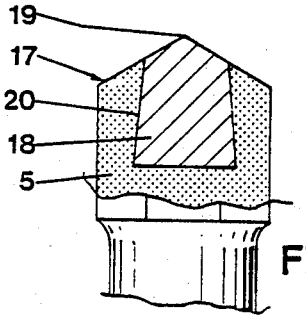
FIG. 5 shows a side elevation of a portion of another embodiment of a rotatable drill head provided with a cutter.

FIG. 5 shows another embodiment of a portion 17 of a drill head according to the invention which is likewise made by cold and/or hot isostatic compacting from metal powder 5, but in which a hard, wear-resistant cutter 18 is located which is provided with a relatively sharp cutting edge 19. In this embodiment the cutter 18 is provided with surfaces 20 which similarly diverge from cutting edge 19; by this arrangement the resistance to loosening of the cutter from its mounting under the influence of external forces is increased, and in fact, such loosening is almost impossible.

The invention is not, however, restricted to the exemplary embodiments hereinbefore illustrated, since the inventive concepts and practical embodiments herein offer the solution to other problems in the field of the fastening of metallurgically distinct components which are, however, exposed to the same external wear conditions. Nevertheless the main objective has been satisfied, namely the provision of a relatively simple and thus less expensive drill head.

I claim:

1. In a drill head including a core and a plurality of hard wear-resistant cutting elements, the core comprising powder metal isostatically compacted in a compressible mold, and each of said cutting elements comprising a shank part having opposite ends with a cutting tip at one of said ends, a base part at the end of the shank part opposite from the cutting tip, said base part comprising a flange extending radially outward, said shank part and the base part being embedded in said core in a non-separable bond therewith, said shank part having a tapered shape becoming greater in the direction of said base part, said cutting element thereby fixedly positioned in said core in a manner inhibiting premature loosening of the cutting element from the core body, and said cutting tip extending from the exposed end of said shank part and projecting outward from the surface of said core part.

2. A drill head according to claim 1 wherein each of said cutting elements has a central longitudinal axis, and a typical one of said cutting elements further comprising projection means extending transversely of said axis from said shank part thereof.

* * * * *